US007777108B2

(12) United States Patent
Vosough et al.

(10) Patent No.: US 7,777,108 B2
(45) Date of Patent: Aug. 17, 2010

(54) MUSIC STRING

(75) Inventors: Sina Vosough, Sandviken (SE); Goran Berglund, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 12/096,567

(22) PCT Filed: Nov. 15, 2006

(86) PCT No.: PCT/SE2006/050478

§ 371 (c)(1),
(2), (4) Date: Oct. 17, 2008

(87) PCT Pub. No.: WO2007/067135

PCT Pub. Date: Jun. 14, 2007

(65) Prior Publication Data

US 2009/0071313 A1 Mar. 19, 2009

(30) Foreign Application Priority Data

Dec. 7, 2005 (SE) ..... 0502693

(51) Int. Cl.
*G10D 3/10* (2006.01)
*G10C 3/08* (2006.01)

(52) U.S. Cl. ..... 84/297 S; 84/199

(58) Field of Classification Search ..... 84/297 S, 84/199

See application file for complete search history.

(56) References Cited

U.S. PATENT DOCUMENTS 1,468,323 A * 9/1923 Olson ..... 84/297 S
2,201,425 A * 5/1940 Berglund ..... 420/38
2,553,707 A 5/1951 Goller
3,660,176 A 5/1972 Denhard, Jr.
4,063,674 A * 12/1977 Stone et al. ..... 228/173.5
4,333,379 A * 6/1982 Meinel et al. ..... 84/297 S
5,147,475 A * 9/1992 Holmberg ..... 148/327
5,411,613 A * 5/1995 Rizk et al. ..... 148/606
5,533,982 A * 7/1996 Rizk et al. ..... 604/239
5,587,541 A * 12/1996 McIntosh et al. ..... 84/297 S
5,801,319 A * 9/1998 Hebestreit et al. ..... 84/297 S
6,057,498 A * 5/2000 Barney ..... 84/199
6,248,942 B1 * 6/2001 Hebestreit et al. ..... 84/297 S
6,348,646 B1 * 2/2002 Parker et al. ..... 84/297 R (Continued)

FOREIGN PATENT DOCUMENTS

SE 467 396 7/1992

OTHER PUBLICATIONS

Sandvik Wire, 1KR91 and others, viewed Oct. 13, 2009 at http://www.smt.sandvik.com/sandvik/0140/internet/s001664.nsf/0/EB0D2DFB7DDE7AA4C125752200490C07.*

(Continued)

*Primary Examiner*—Jeffrey Donels
*Assistant Examiner*—Robert W Horn
(74) *Attorney, Agent, or Firm*—Drinker Biddle & Reath LLP

(57) ABSTRACT

A string for musical instrument is disclosed, the string formed from precipitation hardening stainless steel, where Ti has been added to improve the precipitation hardening properties. The string has a superior resistance to relaxation and is corrosion resistant, thus improving its tuning stability and maintaining its tone quality, thus prolonging its service life.

12 Claims, 6 Drawing Sheets

U.S. PATENT DOCUMENTS

| | | | | |
|---|---|---|---|---|
| 6,580,021 | B2 * | 6/2003 | Barney | 84/297 S |
| 7,513,960 | B2 * | 4/2009 | Inoue et al. | 148/326 |
| 7,589,266 | B2 * | 9/2009 | Richter | 84/297 S |
| 2003/0226441 | A1 * | 12/2003 | Barney | 84/297 S |
| 2004/0197581 | A1 * | 10/2004 | Berglund | 428/472 |
| 2006/0102253 | A1 * | 5/2006 | Berglund | 148/222 |
| 2007/0000576 | A1 * | 1/2007 | Blanke | 148/327 |
| 2007/0023108 | A1 * | 2/2007 | Blanke et al. | 148/327 |
| 2007/0137050 | A1 * | 6/2007 | Xu et al. | 30/346.54 |
| 2009/0071313 | A1 * | 3/2009 | Vosough et al. | 84/297 S |
| 2009/0217795 | A1 * | 9/2009 | Vosough et al. | 84/297 S |

OTHER PUBLICATIONS

Custom 455 Stainless, Carpenter Technology Corp., viewed Oct. 13, 2009, at carpentersteel.com/ssalloysprod.aspx?id=2056.*

Sandvik Bioline 1RK91—an Advanced Material . . . , presented Aug. 26, 2004 at ASM Materials & Processes 2004, viewed Oct. 12, 2009 at http://asm.confex.com/asm/md2004/techprogram/paper_1788.htm.*

1RK91 Specification, Sandvik Materials Technology, viewed Oct. 13, 2009 at http://www.smt.sandvik.com/sandvik/0140/Internet/se01598.nsf/Print/9A1DC4AD153F91EEC125764E0058C5D7?OpenDocument.*

"Steel Music Wire", Report of the Tests of Metals and Other Materials for Industrial Purposes, United States Testing Machine at Watertown Arsenal, Massachusetts, during the Fiscal Year ended Jun. 30, 1894. Government Printing Office, Washington, D. C. , 1895. http://books.google.com/books?id=dVQOAAAAYAAJ&pg=RA7-PA319#v=onepage&q&f=false Apr. 26, 2010.*

Stainless Steel Mechanical Properties. A to Z Materials © 2000. http://www.azom.com/details.asp?ArticleID=1181 viewed Apr. 26, 2010.*

Swenson, Edward E., Chronologically Arranged Wire Tests © 2008. viewed at http://www.mozartpiano.com/en/articles/wiretests.php Apr. 26, 2010.*

Tinned Music Wire—Coils, citation of tensile strength, viewed Apr. 27, 2010 at http://www.fortepiano.com/wire/TinMusic/tinmusic.htm.*

Phosphor Bronze Coils, citation of tensile strength, viewed Apr. 27, 2010 at http://www.fortepiano.com/wire/PhosBronze/phosbronze.htm.*

* cited by examiner

MUSIC STRING

RELATED APPLICATION DATA

This application is a §371 National Stage Application of PCT International Application No. PCT/SE2006/050478 filed Nov. 15, 2006 and also claims priority to Swedish Application No. 0502693-5, filed Dec. 7, 2005.

The present invention relates to a music string according to the preamble of claim 1.

Such a string is known from inter alia U.S. Pat. No. 4,333,379 comprising a steel core of bronzed gray cast iron.

A music string must possess many different properties. The most important is a high mechanical strength which allows the string to be loaded to its tuning frequency, and to resist the variations in tension in the string when played on. The level of mechanical strength required depends on the diameter of the string. Finer strings are used for the higher tones and generally, the finer the string the higher the mechanical strength required. For example, a 0.254 mm (0.010") guitar string to be used for the tone E must have a tensile strength of at least 1500 MPa to be tuned. Furthermore, in order to safely withstand the tensions created when played on by a plectrum, the 0.254 mm string should preferably have a tensile strength of approximately 2500 MPa.

Another important property is the resistance to relaxation of the string material. This property basically tells how well the guitar string will maintain its tune. For example, a loss of force in the magnitude of 1 N in a string of diameter 0.33 mm, loaded to the tone B on a guitar (i.e. 247 Hz), corresponds to a drop of approximately 2 Hz in frequency. Since the human ear can detect the difference between, e.g., 440 Hz and 441 Hz, a force loss of 1 N will be well audible for the human ear. If a drop like this occurs, the string needs to be retuned. Frequent retuning is disturbing for the musician, and will over time deteriorate the properties of the string. Hence, eventually the tone quality of the string will be affected and thereby also the life time of the string. Consequently, for improved tuning stability, tone quality and string life, it is desirable that the string material has a high resistance to relaxation.

Another essential property of the string material is its ability to be cold drawn to the required wire dimensions, without becoming too brittle. Furthermore, the string may constitute a single wire, one or more twisted wires or a wrapped wire. This in turn requires that the material be sufficiently ductile to allow the string wire to be twisted.

In case of a string for electrical instruments, such as an electrical guitar, the sound generated by the string is a result of the electromagnetic properties of the string. Most electric guitars apply electromagnetic pickups which consist of a coil with a permanent magnet. The string vibrations cause changes in the magnetic flux through the coil, thus inducing electrical signals, which are transferred to an amplifier where the signal is further processed and amplified. The more magnetic the string, the higher voltage the produced in the coil and the louder the sound created.

Moreover, a string of a musical instrument is exposed to different types of corrosion. The corrosion will stain the string, thereby affecting both the mechanical properties and the tuning properties over time. One type of corrosion to which a string is subjected is atmospheric corrosion, which can be substantial on carbon steel in humid and warm conditions or, when the instrument is played on outdoors. Furthermore, substances such as sweat or grease may be transferred from the musician to the string, which may constitute a risk of corrosion of the string. Human sweat contains sodium chloride which is highly corrosive. Grease on the other hand may collect other substances that corrode the string lightly and discolor the surface of it permanently.

Ordinary strings are commonly made of high carbon steel drawn to different wire diameters. Carbon steel has many good qualities, such that it is easy to draw wire to high strength levels without encountering brittleness. However, a major drawback of carbon steel when used in strings is that it rusts easily, thus staining the surface which will affect the tone quality and playing characteristics of the string. Staining is a common reason for restringing an instrument.

Many attempts to arrest corrosion on carbon steel strings have been done without success, e.g., coating strings with different materials such as natural and synthetic polymers. However, coating generally decreases the string vibrations, thus leading to reduced brightness and an inferior sound quality.

Yet another drawback of carbon steel when used in strings is its tendency to be stretched when loaded. This effect caused by relaxation of the material is particularly noticeable the first period after stringing a new instrument or after restringing an old instrument, both on large, static instruments such as pianos, and on small, mobile instruments such as guitars and violins. A new string requires a "setting time" until is reaches a stable tone. Obviously, the instrument itself accounts for a large portion of the "detuning" as a result of variations in humidity and temperature, but much of the effect is attributed to the strings. For a piano producer, for instance, this means a long and costly period of tuning and retuning before delivery of a new instrument, and for an instrument player it means frequent retuning until an acceptable stability of tone has been reached.

Therefore, there is a need for a string which will overcome the problems given above.

Consequently, the object of the invention is to provide a music string with extended service life.

SUMMARY

The stated object is achieved by a string as initially defined and having the features of the characterizing portion of claim 1.

By utilizing a precipitation hardening stainless steel in music strings both the corrosion resistance and the resistance to relaxation are much improved compared to commonly used carbon steel strings and thereby the life time of the string is prolonged.

The string is intended for use in acoustic and semi-acoustic instruments as well as in instruments where the tone is generated by the string vibrating in a magnetic field such as electric guitars. The string according to the present disclosure may be used in all kinds of stringed musical instruments, such as guitars, violins, pianos, harps etc.

DETAILED DESCRIPTION

Figure 1:
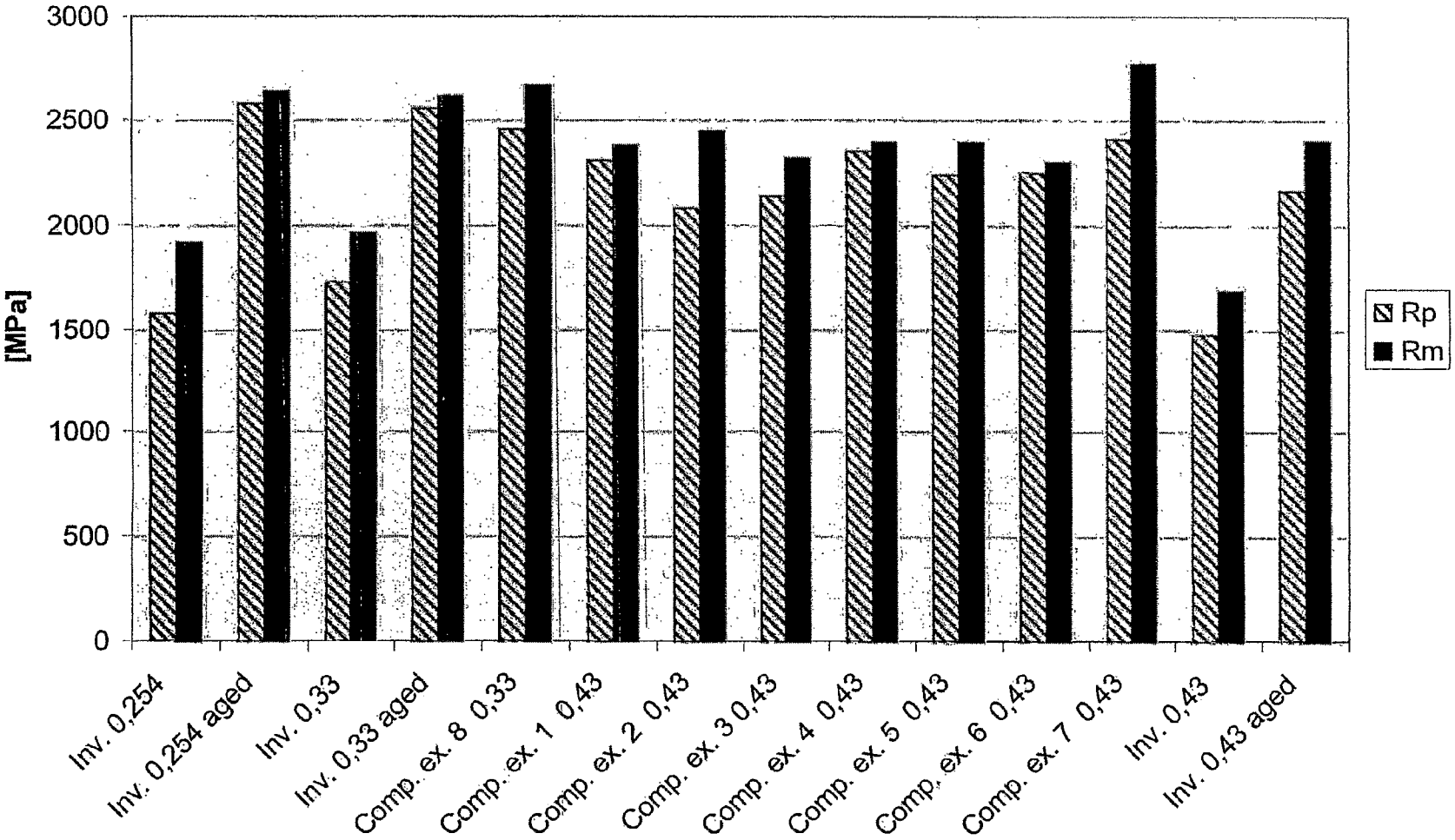
FIG. 1 illustrates the result of tensile test of strings according to the invention and strings of comparative examples.

The different material properties of importance for the performance of a music string are the yield and tensile strength, the resistance to relaxation, the corrosion resistance, the shape, the surface finish, and, for electrical instruments, the electromagnetic properties.

The string in accordance with the present invention has a prolonged service life compared to commonly used strings. In this context, service life is considered to be the time up to breakage of the string or the time to when the musician feels the need to change the string due to deteriorated properties of the string, such as a loss of tuning stability or tone quality.

Precipitation hardening stainless steels are corrosion resistant ferrous alloys that have been strengthened by precipitation hardening. The precipitation hardening produces a multiphase structure resulting in an increased resistance to dislocation motion and hence greater strength or hardness. These types of steel can generally be found in applications such as corrosion resistant structural members.

Resulting from the materials selection, a string according to the present disclosure has a high mechanical strength, such as a tensile strength of at least 1800 MPa when in a diameter of 0.33 mm and in cold drawn condition. Also, the tensile strength is at least 2500 when in a diameter of 0.254 mm and in heat treated condition, i.e. aged. Furthermore, it has a resistance to relaxation which does not necessitate a retuning more frequently than once every 18 hours when played on under normal conditions. More specifically, the precipitation hardening stainless steel has a resistance to relaxation sufficient to necessitate retuning less than once every 24 hours.

Moreover, the string according to the present disclosure is resistant to corrosion caused by the environment or substances transferred to the string during its use. As a consequence, the string does not need to be coated for improved protection and maintains its bright surface, and thus its acoustic characteristics over time.

The common methods used to assess the corrosion resistance of carbon steel and stainless steel differ substantially, which makes a direct comparison difficult based on lab tests. However, carbon steel rusts strongly in sweat water, and even more so in chloride containing waters. Stainless steels on the other hand resist pure water but may be subject to pitting corrosion in chloride containing water. The corrosion process is accelerated if the chloride content and/or the higher temperature are high. For its strength level, the precipitation hardening stainless steel of the invention is quite resistant in aqueous solutions and performs better than, e.g., stainless steel of type AISI 304. This also means that it outperforms carbon steel music strings in this respect.

A uniform shape and a smooth surface finish of the string are important for achieving a harmonic sound and a good feeling of the string when played. The acoustic properties of a string are difficult to quantify but are very important for how the musician and the listener experience the sound of the string. The perception of the acoustic sound of strings according to the present invention is similar to that of commonly used carbon steel strings.

Suitable precipitation hardening stainless steels, to be used in music strings in accordance with the present invention, generally contain 10-20 percent by weight of Cr and 4-10 percent by weight of Ni.

A precipitation hardening stainless steel suitable for use as music string could, for example, have the following composition in percent per weight:

| | |
|---|---|
| C | max 0.1 |
| Si | max 1.5 |
| Mn | 0.2-3 |
| S | max 0.1 |
| P | max 0.05 |
| Cr | 10-19 |
| Ni | 4-10 |
| Mo + 0.5W | max 6 |
| Cu | max 4.5 |
| one or more of the elements Ti, Nb, Ta and Al | >0-2 |

Balance Fe and normally occurring impurities.

Examples of such stainless steels are UNS S46910, UNS S17700, UNS S17400 and UNS S45500. According to a preferred embodiment, the precipitation hardening stainless steel is UNS S46910.

The precipitation hardening stainless steel may comprise various additions for accomplishing precipitations. According to an embodiment of the invention, the precipitation hardening stainless steel comprises 0.5-1% by weight of Ti such as in the case of UNS S46910 and UNS S45500. According to another embodiment of the invention, the stainless steel comprises 0.2-1.5% by weight of Al such as in the case of UNS S17700 and UNS S46910. According to yet another embodiment, the steel comprises 0.1-0.6% by weight of Ta+Nb as in the case of UNS S45500 and UNS S17400.

An important criterion when selecting a suitable precipitation hardening stainless steel for a music string is the ability to manufacture wires of the material in order to produce the string. It is a prerequisite that the selected composition can be cold drawn to very fine diameters such as 0.254 mm or 0.33 mm without becoming brittle.

The string is produced by means of conventional cold drawing processes for the manufacturing of wire. The cold drawing process gives rise to formation of deformation-induced martensite which leads to increased mechanical strength and a more magnetic material. The amount of cold deformation is important for achieving the desired strength and magnetic properties of the wire.

In order to further improve the properties of the string, the precipitation hardening stainless steel may be subjected to a heat treatment at 400-550° C., normally for up to 4 hours. This aging heat treatment produces a precipitation hardening of the material which substantially increases its tensile strength.

The manufacturing processes for producing wire of precipitation hardening stainless steel result in strings of good surface finish, i.e. strings with a uniform and harmonious sound that are comfortable to play on.

According to an embodiment, the string comprises a core wrapped with metal strands. In this embodiment, either the core or the wrapping consists of precipitation hardening material in accordance with the invention. It is also possible that both the core and the wrapping comprise precipitation hardening stainless steel.

The string according to the present disclosure may be used in all kinds of stringed musical instruments, such as guitars, violins, pianos, harps etc. The string may be a single wire, but it may also be in the form of a wrapped or wounded string. The string may also be twisted.

EXAMPLE 1

Test wires were produced of a precipitation hardening stainless steel with the following approximate composition (all in percent by weight):

| | |
|---|---|
| C | 0.01% |
| Si | 0.2% |
| Mn | 0.3% |
| Cr | 12% |
| Ni | 9% |
| Mo | 4% |
| Co | 0.6% |
| Ti | 0.9% |
| Cu | 2% |
| Al | 0.3% |

balance Fe and normally occurring impurities.

This alloy is standardized under US-standard AISI UNS S46910.

Wires were cold drawn to diameters of 0.254 mm, 0.33 mm and 0.43 mm, respectively. One wire of each diameter was heat treated at a temperature of 475° C. for 10 minutes, resulting in an increased strength and a further improved resistance to relaxation of the material.

The yield and tensile strengths were measured by a tensile test in accordance with SS-EN10002-1 and compared to 8 different comparative examples of carbon steel strings. The approximate compositions and string diameters of the comparative examples are shown in Table 1. The yield ($Rp_{0,2}$) and tensile (Rm) strength values are listed in Table 2 and are illustrated in FIG. 1. It appears that the mechanical properties of the precipitation hardening stainless steel, both in the as-drawn and the as-aged condition, match well the characteristics of the conventional strings. The positive effect of aging is clearly shown in Table 2.

TABLE 1

| Comparative sample no. | Fe (+C) | Si | Mn | Diameter of string [mm] |
|---|---|---|---|---|
| 1 | 99.2 | 0.2 | 0.7 | 0.43 |
| 2 | 98.9 | 0.3 | 0.7 | 0.43 |
| 3 | 99.3 | 0.2 | 0.5 | 0.43 |
| 4 | 99.2 | 0.2 | 0.7 | 0.43 |
| 5 | 99.3 | 0.2 | 0.5 | 0.43 |
| 6 | 99.1 | 0.2 | 0.7 | 0.43 |
| 7 | 99.3 | 0.3 | 0.5 | 0.43 |
| 8 | 99.2 | 0.2 | 0.6 | 0.33 |

TABLE 2

| Sample | $Rp_{0.2}$ [MPa] | Rm [MPa] |
|---|---|---|
| Comp. ex. 1 | 2307 | 2384 |
| Comp. ex. 2 | 2076 | 2446 |
| Comp. ex. 3 | 2140 | 2322 |
| Comp. ex. 4 | 2348 | 2392 |
| Comp. ex. 5 | 2239 | 2394 |
| Comp. ex. 6 | 2251 | 2300 |
| Comp. ex. 7 | 2408 | 2772 |
| Comp. ex. 8 | 2455 | 2665 |
| Inv. 0.254 cold drawn | 1577 | 1919 |

TABLE 2-continued

| Sample | $Rp_{0.2}$ [MPa] | Rm [MPa] |
|---|---|---|
| Inv. 0.33 cold drawn | 1726 | 1961 |
| Inv. 0.43 cold drawn | 1471 | 1687 |
| Inv. 0.254 aged | 2579 | 2638 |
| Inv. 0.33 aged | 2556 | 2615 |
| Inv. 0.43 aged | 2166 | 2403 |

EXAMPLE 2

The relaxation resistance was tested by plucking 0.254, 0.33 mm diameter and 0.43 mm diameter strings approximately 200 times per minute with a pick. The compositions are those of example 1. The test was performed over a 24 hour period. The plucking point of the pick was set at 18 cm from a force sensor connected to a computer. The total length of each string was 65 cm and the strings rested on two plastic pieces at each end point. The distance between each end point and its corresponding force sensors was 5 cm. The diameter and its corresponding tone frequency are given in Table 3 along with the original tension and the engineering stress of the strings.

TABLE 3

| Diameter [mm] | Tone frequency [Hz] | Tension [N] | Engineering stress [MPa] |
|---|---|---|---|
| 0.254 | 330 | 71.8 | 1417 |
| 0.33 | 247 | 68.5 | 801 |
| 0.43 | 196 | 73.9 | 509 |

Figure 2:
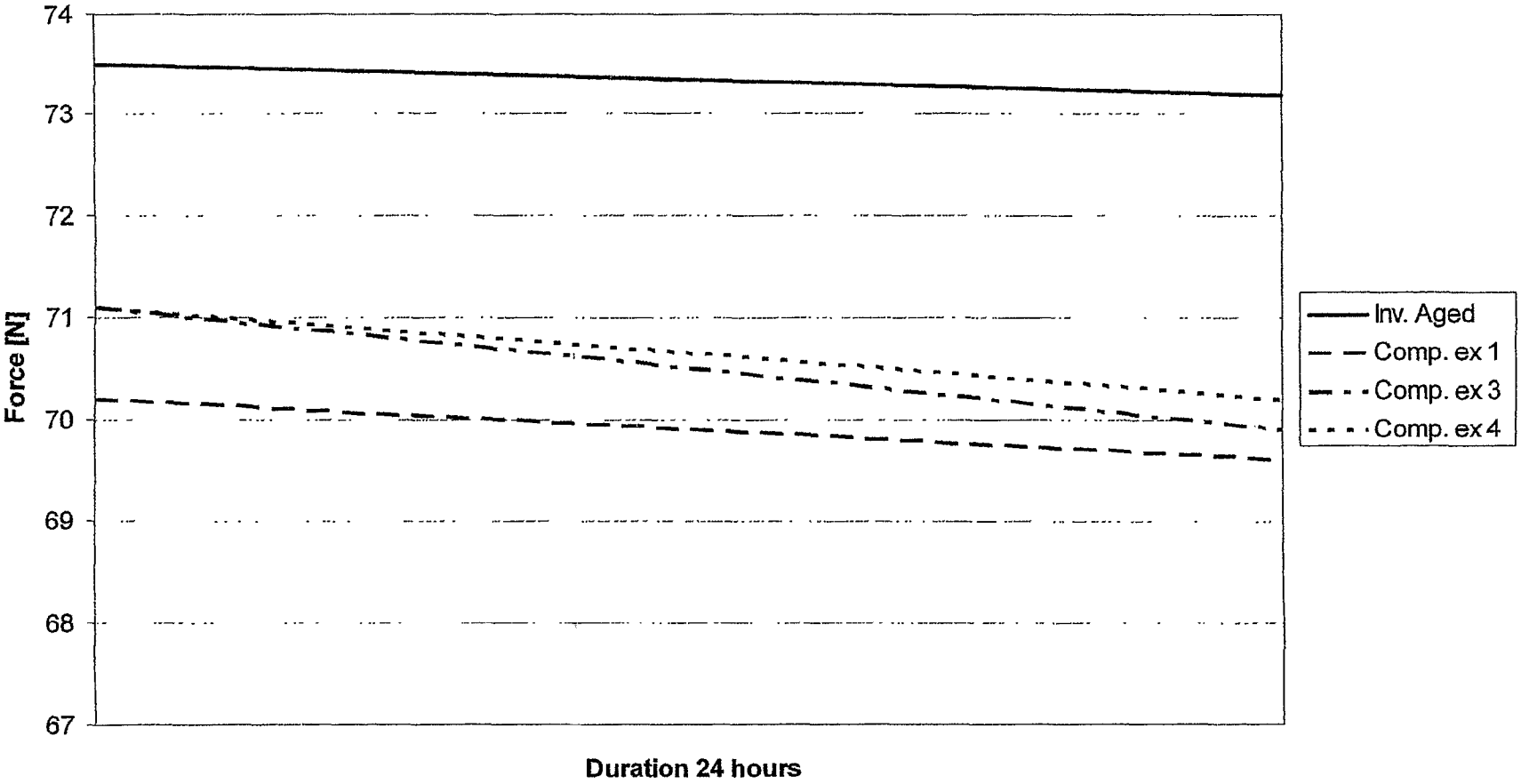
FIG. 2 illustrates the result of a relaxation test of wires with a diameter of 0.254 mm.
Figure 3:
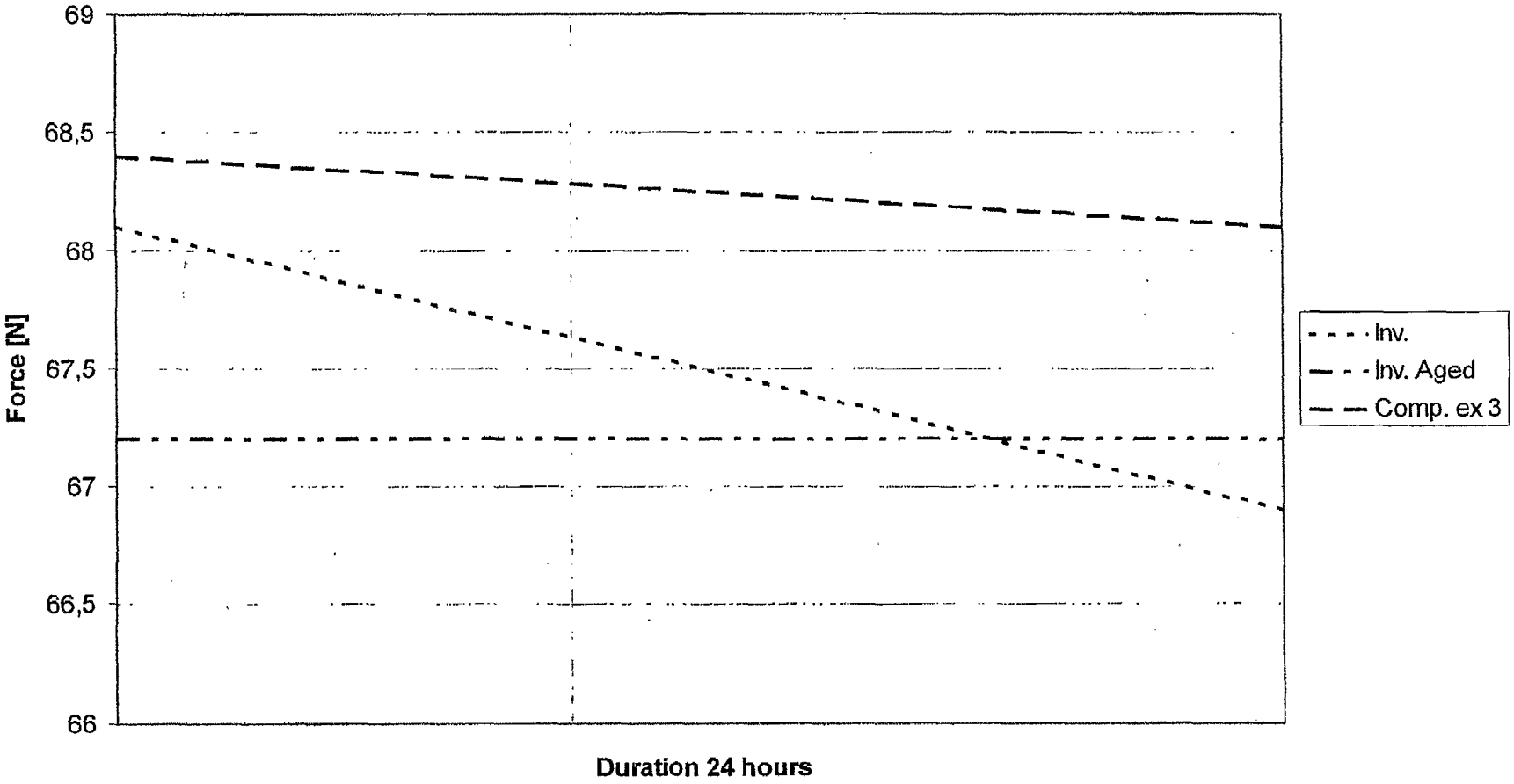
FIG. 3 illustrates the result of a relaxation test of wires with a diameter of 0.33 mm.
Figure 4:
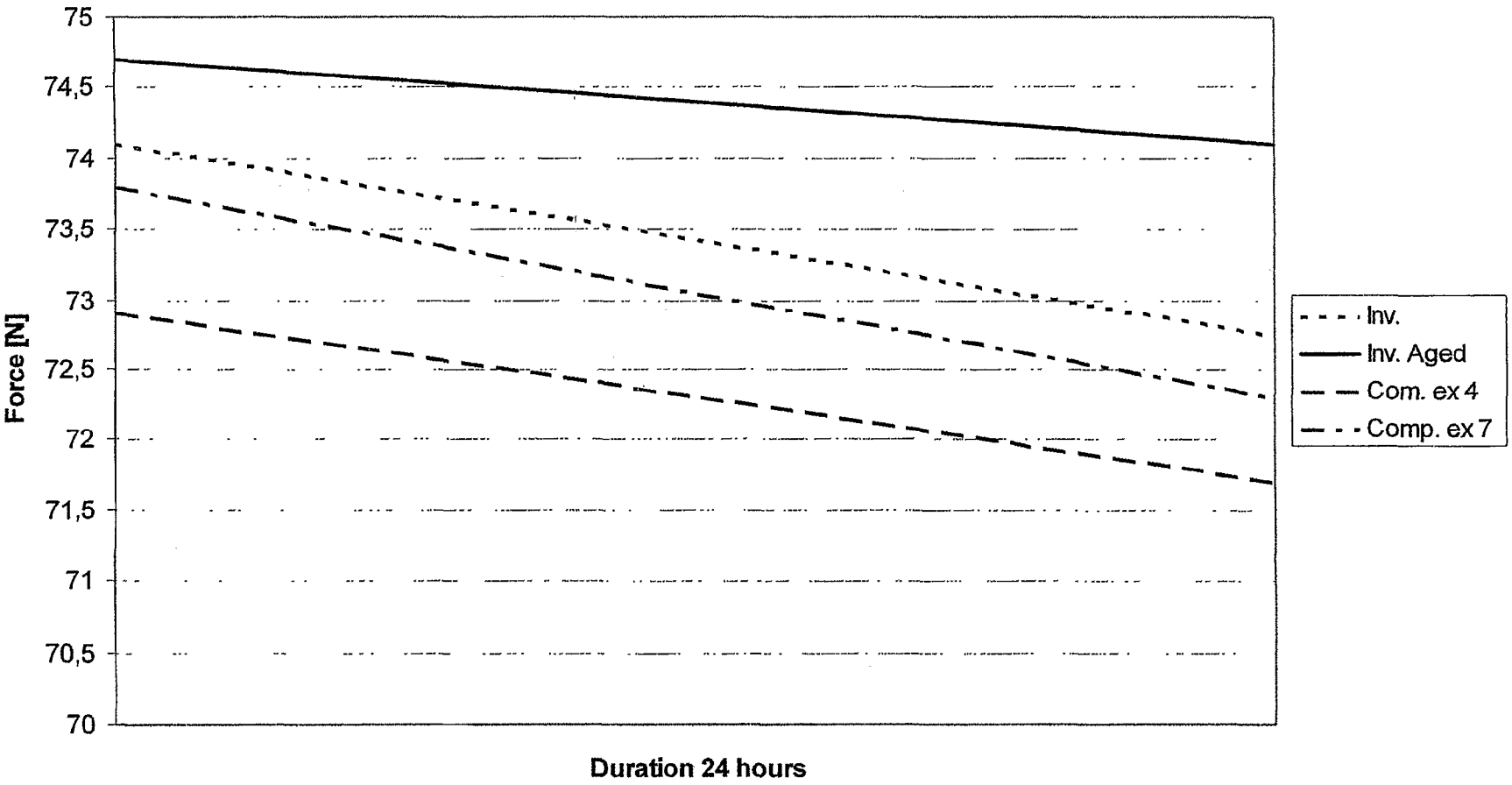
FIG. 4 illustrates the result of a relaxation test of wires with a diameter of 0.43 mm.

The results of the relaxation tests of strings with diameters 0.254 mm, 0.33 mm and 0.43 mm are shown in FIG. 2, FIG. 3 and FIG. 4 respectively. In Table 4, the same results are listed in the form of the linear Equation 1, wherein y is the load applied, k is a constant, x is the time and $y_o$ the initial load. The frequency loss is calculated based on a density of 7700 kg/m$^3$.

$$y(x)=-k*x+y_o \qquad \text{Equation 1}$$

TABLE 4

| Sample | Start tension [N] | Tension after 24 h [N] | Frequency loss [Hz] | Equation with slope (k-value) |
|---|---|---|---|---|
| Comp. ex. 1 0.254 mm | 70.2 | 69.6 | 1.40 | y = −0.025x + 70.2 |
| Comp. ex. 3 0.254 mm | 71.1 | 69.9 | 2.78 | y = −0.05x + 71.1 |
| Comp. ex. 4 0.254 mm | 71.1 | 70.2 | 2.08 | y = −0.0375x + 71.1 |
| Comp. ex. 3 0.33 mm | 68.4 | 68.1 | 0.54 | y = −0.0125x + 68.4 |
| Comp. ex. 4 0.43 mm | 72.9 | 71.7 | 1.62 | y = −0.05x + 72.9 |
| Comp. ex. 7 0.43 mm | 73.8 | 72.3 | 2.02 | y = −0.0625x + 73.8 |
| Inv. 0.33 mm cold drawn | 68.1 | 66.9 | 2.19 | y = −0.05x + 68.1 |
| Inv. 0.43 mm cold drawn | 74.1 | 72.8 | 1.74 | y = −0.0563x + 74.1 |
| Inv. 0.254 mm heat treated | 73.5 | 73.2 | 0.68 | y = −0.0125x + 73.5 |
| Inv. 0.33 mm | 67.2 | 67.2 | 0.0 | y = −0.00x + 67.2 |

TABLE 4-continued

| Sample | Start tension [N] | Tension after 24 h [N] | Frequency loss [Hz] | Equation with slope (k-value) |
|---|---|---|---|---|
| heat treated Inv. 0.43 mm heat treated | 74.7 | 74.1 | 0.8 | y = −0.025x + 74.7 |

The lower the k-value, i.e., the slope of the linear equation for a given string, the better is its relaxation resistance. The results furthermore show that the precipitation hardening stainless steel in heat treated condition, i.e. aged, has better relaxation resistance compared to traditional carbon steel used in music strings. The strong positive effect of aging on the relaxation resistance is clearly demonstrated.

The human ear can detect a change in tune frequency of 1 Hz. The string of Comparative Example 7 had lost 1.5 N (corresponding to a frequency lost of approximately 2 Hz) after 24 hours which means that such a string must be retuned once every 12 hours. On the other hand, a string according to the invention having with a corresponding diameter and heat treated condition had lost 0.6 N corresponding to a frequency lost of approximately 0.8 Hz, which in turn results in a need for retuning once every 30 hours.

For comparison, a string according to the invention having a diameter of 0.254 mm and being in heat treated condition had lost 0.3 N which corresponds to a frequency lost of approximately 0.68 Hz. This results in a need for retuning once every 35 hours.

EXAMPLE 3

Figure 5:
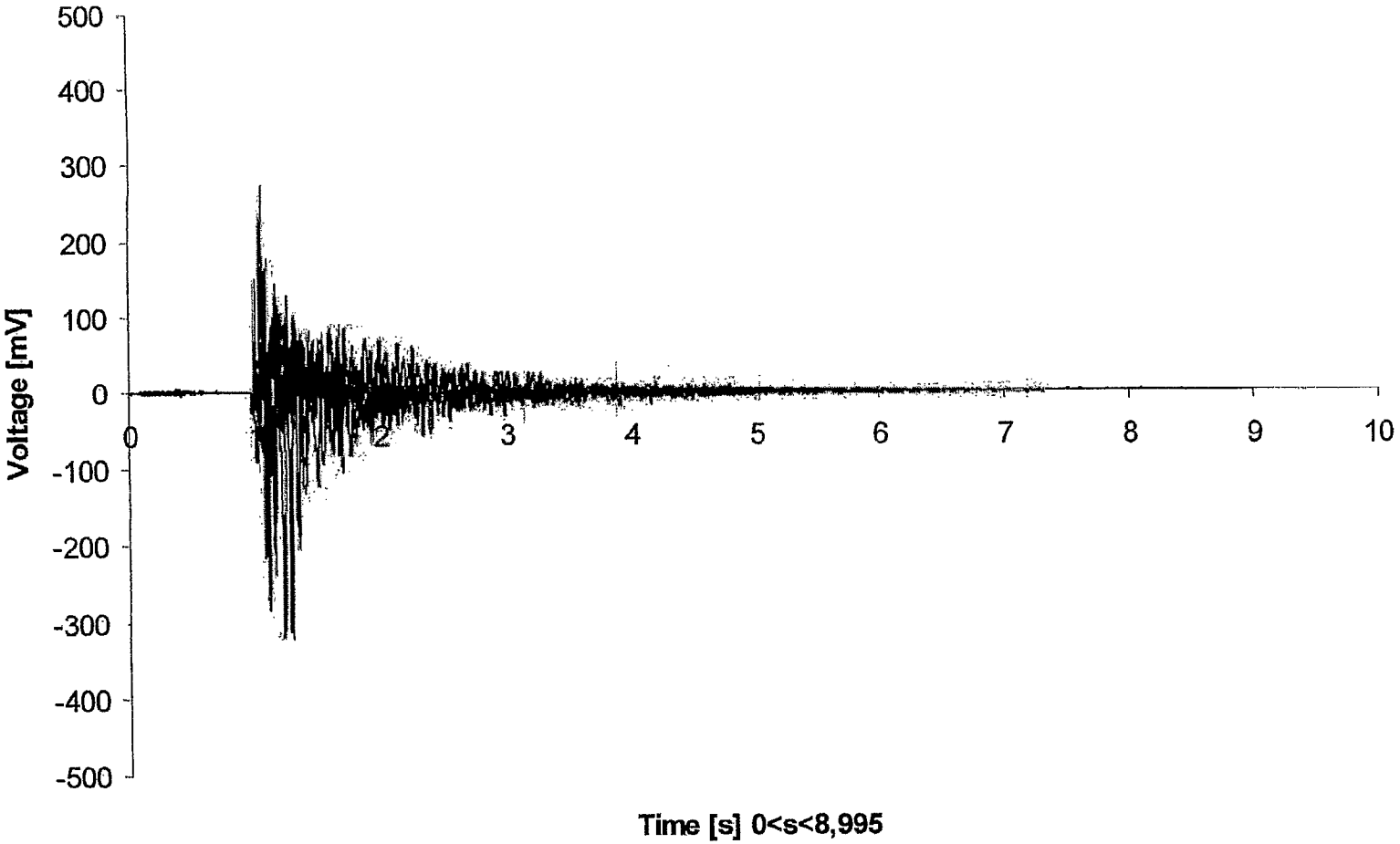
FIG. 5 illustrates the result of a magnetic resonance test of a string according to the present invention.
Figure 6:
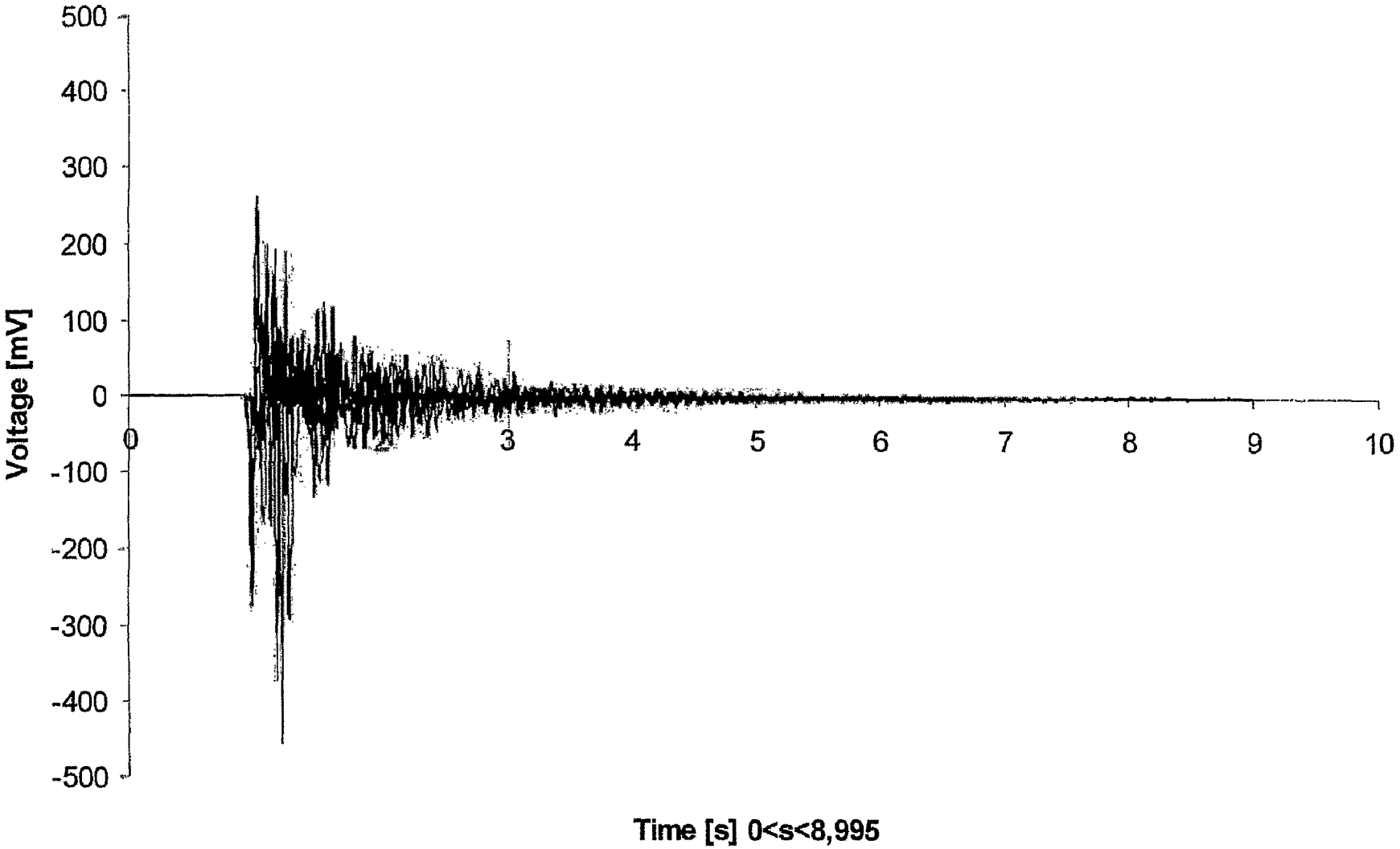
FIG. 6 illustrates the result of a magnetic resonance test of a string of a comparative example.

The magnetic resonance of the alloy of Example 1 was tested on a guitar and compared to that of Comparative Example 7. The strings were plucked at a distance of 10 cm from the bridge and subjected to a force corresponding to the shear-breaking point of a 0.10 mm copper wire. The copper wire was looped perpendicularly around the plucked string and then pulled until reaching the breaking point. In this way the same force was applied for every test run. The breaking point of the copper wire must also be at the point of contact with the plucked string, if the copper wire broke at any other point the procedure was repeated. A series of five approved tests were done on each string, and the results are represented in graphs as per FIGS. 5 and 6. The result shows that the ageing process does not affect the magnetic properties of the material.

EXAMPLE 4

Furthermore the magnetic weight of the material was tested and compared to Comparative example 4. To measure the amount of magnetic phase, a magnetic balance was used. The magnetic balance contains two major components, an electromagnet and a strain gauge. The electromagnet generates a strong inhomogenic magnetic field between two wedge-shaped poles where the test sample is placed. A magnetic string will be pulled down by the magnetic force. The force, which is proportional to the amount of magnetic phase, is then measured by the strain gauge. This measurement yields the saturation magnetization of the sample and by calculating the theoretical saturation magnetization for this steel it is possible to determine the amount of magnetic phase present in the sample, i.e., the magnetic weight. The values from the magnetic weight tests are illustrated in Table 5.

TABLE 5

| Sample | Length [mm] | Weight [g] | $\sigma_s$ [gauss * cm$^3$/g] |
|---|---|---|---|
| Invention 0.43 mm | 0.58 | 0.228 | 142.1 |
| Comparative example 4 | 0.57 | 0.164 | 193.8 |

It appears that the alloy according to the present invention has a magnetism that is comparable to that of commonly used carbon steel wires, thus making the alloy particularly suitable for applications requiring a magnetic material, i.e., strings for electromagnetic pick-up instruments such as electric guitars.

The invention claimed is:

1. String for musical instrument comprising a precipitation hardening stainless steel, wherein the precipitation hardening stainless steel has a composition, in percent by weight, of:

| | |
|---|---|
| C | max 0.1 |
| Si | max 1.5 |
| Mn | 0.2-3 |
| S | max 0.1 |
| P | max 0.05 |
| Cr | 10-19 |
| Ni | 4-10 |
| Mo + 0.5W | max 6 |
| Cu | max 4.5 |
| one or more of the elements Ti, Nb, Ta and Al | >0-2, where the amount of Ti is 0.5-1 |

balance Fe and normally occurring impurities.

2. String for musical instrument according to claim 1 comprising 0.2-1.5% by weight of Al.

3. String for musical instrument according to claim 1 comprising 0.1-0.6% by weight of Ta+Nb.

4. String for musical instrument according to claim 1 wherein the precipitation hardening stainless steel is UNS S46910.

5. String for musical instrument according to claim 1 wherein the precipitation hardening stainless steel is UNS S45500.

6. String for musical instrument according to claim 1 wherein the music string has a tensile strength of at least 1800 MPa when in a diameter of 0.33 mm.

7. String for musical instrument according to claim 1 wherein the music string has a resistance to relaxation such as it will resist a loss of frequency of 2 Hz for at least 18 hours.

8. String for musical instrument according to claim 1 wherein the precipitation hardening stainless steel is in the cold drawn condition.

9. String for musical instrument according to claim 1 wherein the precipitation hardening stainless steel is in the heat treated condition.

10. String for musical instrument according to claim 9 wherein the music string has a tensile strength of at least 2500 when in a diameter of 0.254 mm.

11. String for musical instrument according to claim 1 comprising a core of precipitation hardening stainless steel wrapped with metal strands.

12. Music instrument comprising a string for musical instrument according to claim 1.

* * * * *